US005873321A

United States Patent [19]

Asano et al.

[11] Patent Number: 5,873,321

[45] Date of Patent: Feb. 23, 1999

[54] SEWING DEVICE WITH A BED SWITCHABLE BETWEEN A USAGE POSITION AND A RETRACTED POSITION

[75] Inventors: Fumiaki Asano, Nagoya; Akio Takahashi, Gifu-ken; Yoshikazu Kurono, Aichi-ken; Masaki Shimizu, Toyoake, all of Japan

[73] Assignee: Brother Kogyo Kabushiki Kaisha, Nagoya, Japan

[21] Appl. No.: 747,385

[22] Filed: Nov. 12, 1996

[30] Foreign Application Priority Data

Nov. 20, 1995 [JP] Japan ..... 7-328089

[51] Int. Cl.[6] ..... D05B 73/04

[52] U.S. Cl. ..... 112/260

[58] Field of Search ..... 112/78, 98, 103, 112/155, 163, 168, 260, 285, 291

[56] References Cited

U.S. PATENT DOCUMENTS

| | | | |
|---|---|---|---|
| 3,799,089 | 3/1974 | Tolle | 112/258 X |
| 4,168,671 | 9/1979 | Roberts et al. | 112/260 X |
| 4,204,493 | 5/1980 | Blackwood et al. | 112/260 |
| 4,426,947 | 1/1984 | Marshall | 112/260 X |
| 4,520,744 | 6/1985 | Portilla | 112/260 |
| 4,590,875 | 5/1986 | Sanvito et al. | 112/260 X |
| 4,691,651 | 9/1987 | Junemann | 112/260 X |
| 4,834,010 | 5/1989 | Choi et al. | 112/165 X |
| 5,337,686 | 8/1994 | Nagata | 112/260 |
| 5,458,075 | 10/1995 | Tice et al. . | |
| 5,474,001 | 12/1995 | Tajima et al. . | |
| 5,531,172 | 7/1996 | Kojima et al. | 112/260 |

FOREIGN PATENT DOCUMENTS

| | | |
|---|---|---|
| 60-21750 | 5/1985 | Japan . |
| 61-15816 | 5/1986 | Japan . |
| 3-234291 | 10/1991 | Japan . |
| 4-51991 | 4/1992 | Japan . |
| 6-126054 | 5/1994 | Japan . |
| 6-184911 | 7/1994 | Japan . |

*Primary Examiner*—Ismael Izaguirre
*Attorney, Agent, or Firm*—Oliff & Berridge, PLC

[57] ABSTRACT

A sewing device including a head portion for mounting a needle; a support frame; and a bed unit supported on the frame and switchable between a usage position in confrontation with the head portion and a retracted position retracted away from the head portion compared with the usage position.

22 Claims, 10 Drawing Sheets

SEWING DEVICE WITH A BED SWITCHABLE BETWEEN A USAGE POSITION AND A RETRACTED POSITION

BACKGROUND OF THE INVENTION

1. Field of the Invention

The present invention relates to a sewing device suitable for pattern sewing or embroidery sewing.

2. Description of the Related Art

Unexamined Japanese Patent Application (Kokai) No. HEI-6-126054 and U.S. Pat. No. 5,474,001 describe examples of multi-head embroidery machines used as industrial sewing machines for sewing patterns and embroidery.

The multi-head embroidery machine disclosed in Unexamined Japanese Patent Application (Kokai) No. HEI-6-126054 includes a plurality of embroidery machines aligned horizontally (i.e. in an X-direction) at a predetermined interval from each other. A cloth-feeding mechanism is provided for independently driving feeding movement in X and Y directions of a common movable frame on which are attached a plurality of embroidery frames. A needle bar case housing a plurality of needle bars, each corresponding to one of a plurality of colors of embroidery yarn, is provided to a head portion of each embroidery machine. The position of the needle bar case is freely changeable in the vertical direction, as required for the shape of the workpiece cloth. The head portion is configured so that drive force from a main drive shaft, which is driven by a sewing machine motor, is distributed to both a principal shaft and a loop taker shaft of each embroidery machine.

Each of the sewing machines includes a bed portion, a column portion, and an arm portion, which extends vertically from the upper end of the column portion. The head portion is provided to the tip of the arm portion and includes components driven by the principal shaft, such as the needle bars and corresponding sewing needles, and the levers. A loop taker shaft driven by the shuttle shaft is provided to the bed portion. It should be noted that there are two types of bed portion: a bed type capable of sewing only flat pieces of cloth and a cylinder bed type capable of sewing cylindrical pieces of cloth.

U.S. Pat. No. 5,474,001 describes an arm type multi-head type embroidery machine having basically the same configuration as the multi-head type embroidery machine described in Unexamined Japanese Patent Application (Kokai) No. HEI-6-126054. However, this multi-head type embroidery machine is a bridge-type machine wherein the arm portion is dispensed with and also the plurality of head portions and the plurality of the bed portions are integrally fixed to the support frame.

Examined Japanese Patent Application (Kokai) No. SHO-60-21750, Unexamined Japanese Utility Model Application (Kokai) No. SHO-61-15816, and Unexamined Japanese Patent Application (Kokai) No. HEI-3-234291 and describe sewing machines configured so that the loop taker is driven independently from the machine principal shaft by a separate drive motor for loop taker drive. The drive motor for loop taker drive and a transmission system for transmitting the drive force from the drive motor to loop taker drive are fixedly provided to the bed portion.

SUMMARY OF THE INVENTION

In conventional multi-head type embroidery machines, the bed portions are integrally fixed to the support frame, which includes the column portion. Because space between adjoining machines is fixed in conventional multi-head type embroidery machines, the width which the workpiece cloth can be fed in the X direction during sewing is limited by the width of the space. The width of the space between adjoining machines therefore must be preset taking into account sizes of workpiece cloths or the feed width in the X direction which is assumed will be required during sewing. However, when the spaces between adjoining machines are excessively wide, the number of machines that can be placed in a predetermined space is decreased, thereby lowering cost effectiveness of each piece of machinery.

It is conceivable to produce a multi-head type embroidery machine set with a minimal space between adjoining machines to provide as many embroidery machines as possible in a predetermined space. When a piece of cloth with a large width in the X direction is to be sewn, operation of unneeded embroidery machines is stopped while the remaining embroidery machines are operated. However, with this conceivable configuration, the embroidery machines not in use would interfere with feed of the workpiece cloth. Therefore, this configuration is impractical because smooth automatic sewing is difficult to achieve and sewing efficiency is lowered.

In an ordinary one-head type machine, because the bed portion is integrally provided to the machine body, the drive system and the loop taker in the bed portion are difficult to repair so that work efficiency is lowered.

Further, when the principal shaft for driving the needle bar and a loop taker shaft for driving the loop taker are connected and driven together by the same machine motor, the configuration of the drive system for connecting the principal shaft and the loop taker shaft will be complicated. Because the bed portion length differs between types of sewing device, it is difficult to make a drive system for driving the thread loop shuttle common to a plurality of types of sewing machines. Therefore, general usability of the drive system is poor.

It is an objective of the present invention to overcome the above-described problems and to provide a sewing device with high sewing efficiency, high general usability, and low equipment cost; in which assembly and repair of the loop taker or other parts of the bed portion are simple and easy; and wherein the thread loop taker and its drive system can be used in a variety of sewing devices.

In order to achieve the above-described objectives, a sewing device according to the present invention includes a head portion for mounting a needle; a support frame; and a bed unit supported on the frame and switchable between a usage position in confrontation with the head portion and a retracted position retracted away from the head portion compared with the usage position.

A sewing device according to another aspect of the present invention includes a head portion for mounting a needle; a principal shaft for transmitting drive force to drive the head portion; a support frame; a bed portion supported by the frame and including a detachable loop taker module having: a loop taker for holding a thread loop; and a drive motor for driving the shuttle independently from the principal drive shaft.

A sewing device according to a further aspect of the present invention includes a head portion for mounting a needle; a support frame; and a bed portion independently and detachably supported by the frame.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
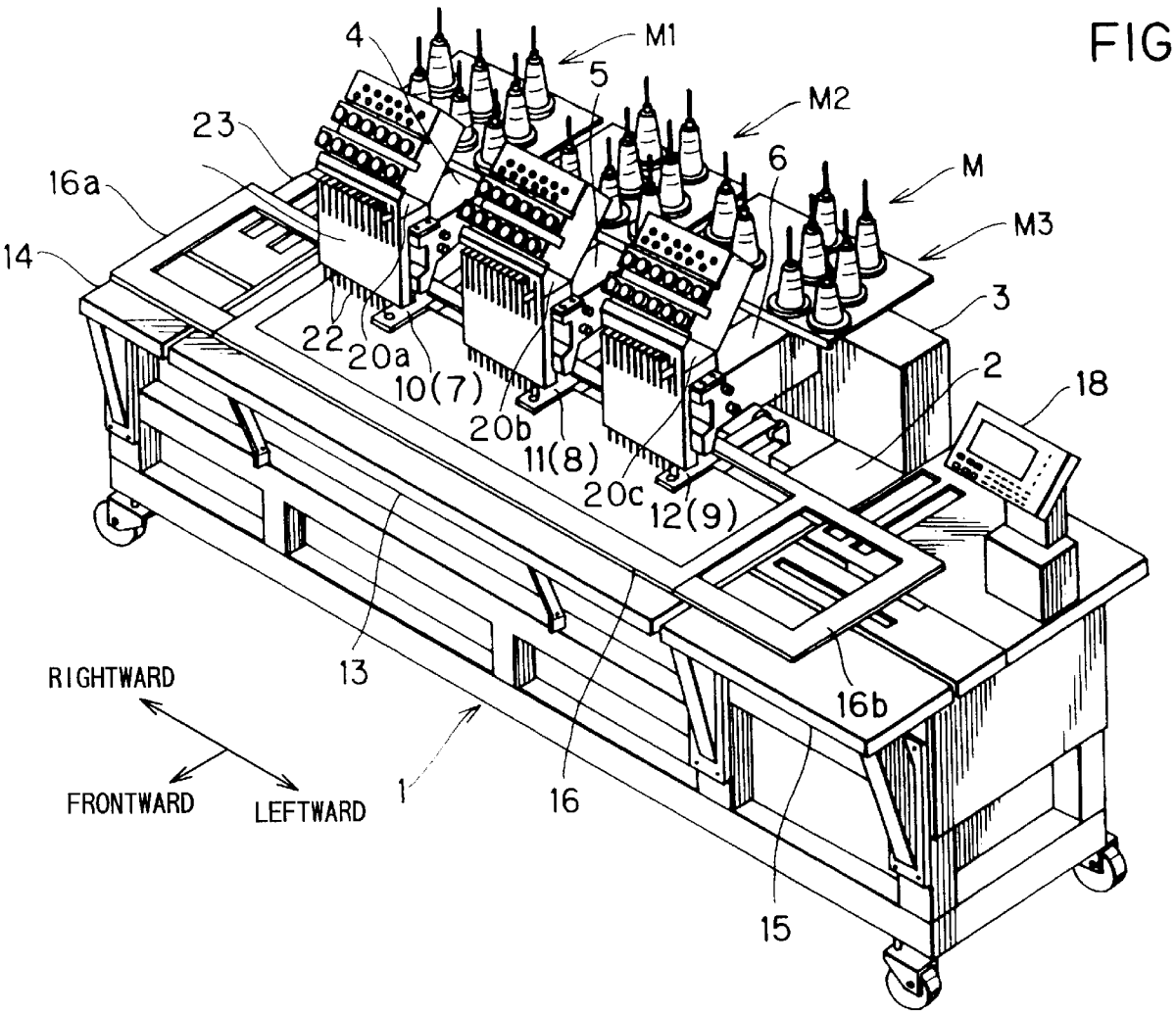
FIG. 1 is a perspective view showing a sewing device according to an embodiment of the present invention.

A sewing machine according to a preferred embodiment of the present invention will be described while referring to the accompanying drawings wherein like parts and components are designated by the same reference numerals to avoid duplicating description.

This embodiment applies the present invention to a multi-head type embroidery machine having three embroidery machines. As shown in FIG. 1, three multi-needle type embroidery machines M1 to M3 are aligned on a base frame 1. The three multi-needle type embroidery machines M1 to M3 include cylindrical bed portions 7 to 9, which include at their tips independent bed units 10 to 12 detachably provided to a support frame 3. The machine support plate 2 is provided to the rear upper surface of the base frame 1. The machine support plate 2 has a substantially rectangular plate shape extending to a predetermined length horizontally, that is, rightward and leftward as shown in FIG. 1. The support frame 3 extends in the horizontal direction and is provided with an upright posture to the rear edge of the machine support plate 2. The three head portions 4 to 6 are aligned along the support frame 3 in the horizontal direction separated by a predetermined distance. The cylindrical bed portions 7 to 9 are supported on the base frame 1 at the front edge of the machine support plate 2 at positions corresponding to respective head portions 4 to 6. The bed units 10 to 12 are swingable via a pivot mechanism 70 at their rear edges and can be detached from the support frame 3.

Twelve needle bars 21 aligned along to the front edge of each head portions 4 to 6 of the embroidery machines M1 to M3 are supported movable the vertical direction in needle bar cases 20*a* to 20*c*, respectively. Twelve levers 23 are swingably supported by each of the needle bar cases 20*a* to 20*c*. Each needle bar case 20 is itself supported movable in the horizontal direction.

A horizontal operation table 13 is provided to the front side of the machine support plate 2 so as to be flush with the upper surface of the bed portions 7 to 9. A pair of side tables 14 and 15 are provided to the right and the left sides of the operation table 13 as viewed in FIG. 1. A rectangular plate-shaped movable frame 16 extends in the horizontal direction to span across the operation table 13 and the side tables 14 and 15.

A drive frame portion 16*a* is disposed at the left edge of the movable frame 16 and is driven to move in an X-axis direction, that is, in the horizontal direction, by an X-axis drive mechanism (not shown in the drawings). A drive frame portion 16*b* is disposed on the right edge of the movable frame 16. The drive frame portion 16*b* and the drive frame portion 16*a* are driven to move in a Y-axis direction, that is, frontward and backward as shown in FIG. 1, by a Y-axis drive mechanism (not shown in the drawings). With this configuration, the movable frame 16 is movable across an X-Y plane by the X-axis and Y-axis drive mechanisms, respectively driven by an X-axis and a Y-axis drive motor (not shown in the drawings). Also, an operation panel 18 for displaying messages about embroidery and for inputting a variety of commands is provided to the rear side of the side table 16*b*.

Figure 2:
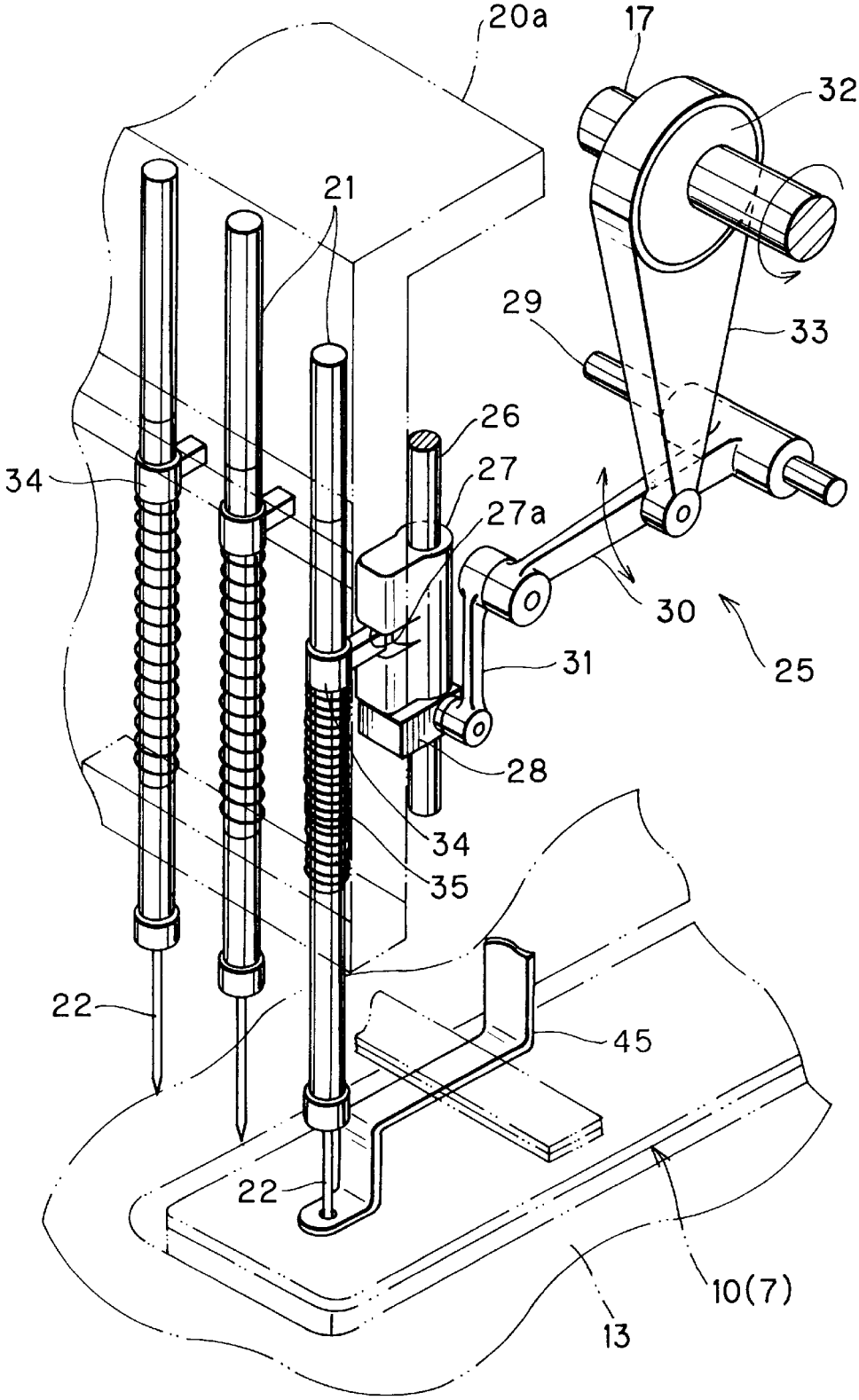
FIG. 2 is a perspective view partially in phantom showing a mechanism for driving vertical movement of needles in a head portion of the sewing device.

Next, an explanation for one of a plurality of needle bar vertical drive mechanisms 25 for driving the needle bar 21 up and down will be provided while referring to FIG. 2.

Figure 3:
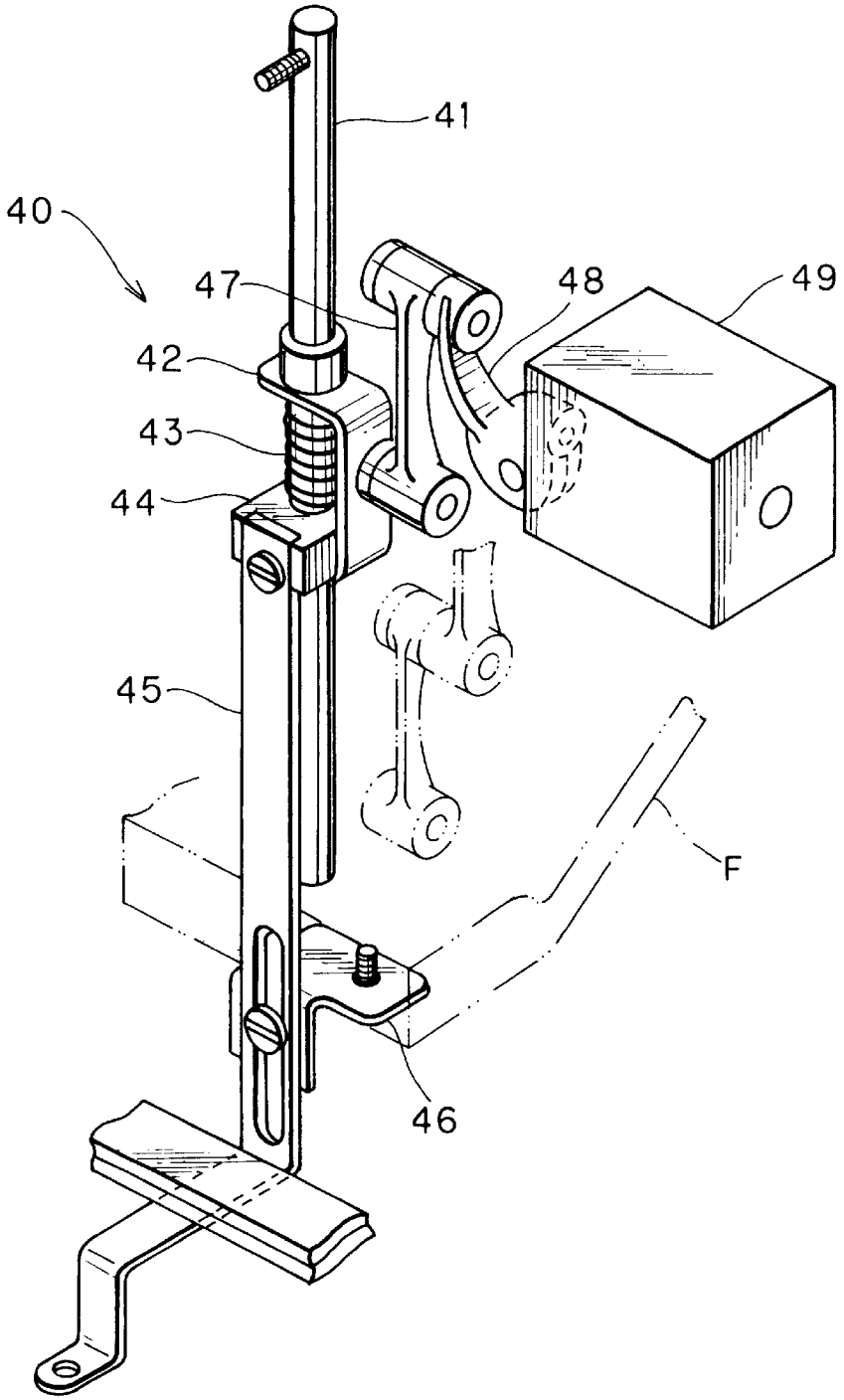
FIG. 3 is a plan view showing a presser foot drive mechanism for vertically moving a presser foot of the sewing device.

A base needle bar 26 extending in the vertical direction is provided on the tip of each head portion 4 to 6 for each needle bar 21. Each base needle bar 26 is fixed at its upper and lower ends to a frame F as shown in FIG. 3. Each base needle bar 26 is inserted into a cylindrical vertical motion member 27 having an engagement groove 27*a* connected to a connecting pin 34 (to be described later). A needle bar holder 28 near the lower end of each vertical motion member 27 is integrally formed with each base needle bar 26. The needle bar holder 28 is connected to a link 31, which is connected to a swing lever 30 swingably supported by a support shaft 29.

An eccentric cam 32 is fixed to a machine principal shaft 17, which is disposed to extend horizontally through each head portion 4 to 6. An eccentric lever 33 supported on the eccentric cam 32 is connected at its lower end to the swing lever 30.

Also, a sewing needle 22 is provided at the lower tip portion of each of the 12 needle bars 21. The connecting pin 34 is fixed to the needle bar 21 at its center in its height direction. A compression spring 35 wound around the needle bar 21 is disposed between the connecting pin 34 and a needle bar support frame at the lower edge of the needle case 20. The needle bar 21 is constantly urged into an upper needle position by the compression spring 35. Further, the connecting pin 34 confronting the vertical motion member 27 can be selectively engaged in the engagement groove 27*a* of the vertical motion member 27.

The sewing machine principal shaft 17 is rotated in a predetermined rotation direction by rotational drive of a machine motor (not shown in the drawings). Corresponding operation of the eccentric lever 33 and the swing lever 30 drives the vertical motion member 27 up and down, thereby driving the needle bar 21 up and down via the connecting pin 34.

The vertical motion member 27 is capable of switching from a connecting position shown in FIG. 2 to a retracted position (not shown in the drawings) by rotating the vertical motion member 27 about 90 degrees using a needle bar connecting motor (not shown in the drawings). When the needle bar connecting motor drives the vertical motion member 27 to switch from the connecting position to the retracted position, the needle bar 21 is moved upward by urging force of the compression spring 35 in what is called a jump operation.

Next, an explanation for a presser foot drive mechanism 40 for vertically moving a presser foot 45 in accordance with sewing operations will be provided while referring to FIG. 3. A support shaft 41 with an upright posture is disposed to the rear side of the base needle bar 26. A vertical motion frame 42 having a reversed C-shape when viewed from the front slidingly supports the support shaft 41. A pressure foot spring 43, formed from a compression spring, and a slide block 44 are slidably fitted on the support shaft 41 to the interior of the vertical motion frame 42. The upper end of the presser foot 45 is fixed to the slide block 44. The lower end of the presser foot 45 is supported movable in the vertical direction by a guide plate 46 on the frame F.

On the other hand, the vertical motion frame 42 is connected to a presser foot drive motor 49 via two links 47 and 48. When a sewing operation is started, the link 48 is driven to rotate by the presser foot drive motor 49. As a result, the two links 47 and 48 are moved downward into the posture shown by a two-dot chain line. This moves the vertical motion frame 42 and the presser foot 45 downward so that the lower edge of the presser foot 45 presses the workpiece cloth. At this time, the spring force of the pressure foot spring 43 generates pressure at the presser foot 45 and also absorbs changes in height of the presser foot 45 caused by workpiece cloths of different thickness. When the sewing operation is finished, the link 48 is driven to rotate to a waiting position shown by the solid line in FIG. 3 so that the movable frame 16 can move.

Next, an explanation for the bed units 10 to 12 will be provided while referring to FIGS. 4 to 8. Because the three bed units 10 to 12 have the same configuration, the leftmost bed unit 10 will be explained as a representative example.

The bed unit 10 includes a bed case 50 substantially U-shaped in cross section and extending in the frontward and rearward directions. The bed case 50 is swingably supported at its rear edge portion on the base frame 1 via a pivot mechanism 70. A loop taker module 53 is detachably fixed to the front end of the bed case 50. The upper side of the bed case 50 is covered with a needle plate 51 at its front portion and with a cover plate 52 near the base frame 1. The cover plate 52 is connected to the needle plate 51.

Figure 7:
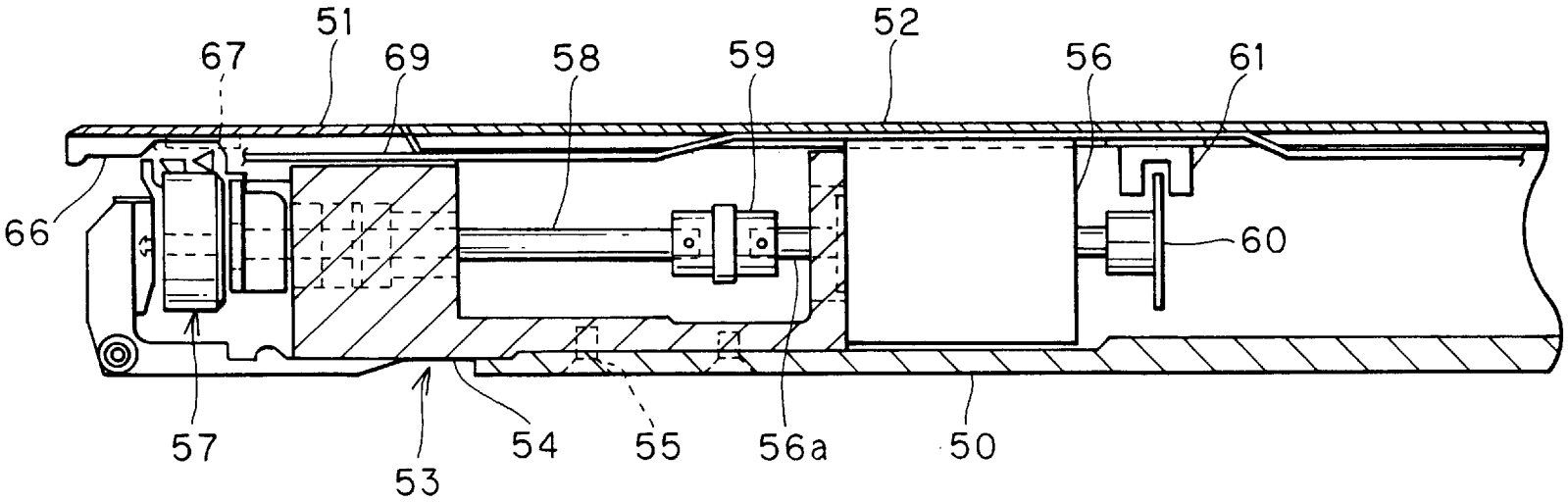
FIG. 7 is a cross-sectional view showing details of the bed unit.

Next, an explanation for the loop taker module 53 will be provided with reference to FIG. 7. An attachment block 54 is detachably fixed to the front edge portion of the bed case 50 by a screw 55. A loop taker drive motor 56 formed from a pulse motor is attached to the rear tip of the attachment block 54. A rotary hook 57 for taking a thread loop is provided to the front tip of the attachment block 54. A loop taker drive shaft 58 fixed to the rotary hook 57 extends rearward through the inside of the attachment block 54 to the loop taker drive motor 56 where a coupling 59 connects it to a drive shaft 56*a* of the loop taker drive motor 56. Further, a disc encoder 60 is attached to the drive shaft 56*a* at the end opposite that attached to the coupling 59. A photosensor 61 for optically detecting a plurality of slits formed in the disc encoder 60 is fixed to the interior wall of the cover plate 52. The loop taker drive motor 56 drives the loop taker drive shaft 58 to rotate so that the rotary hook 57 is driven in a predetermined rotational direction.

Figure 6:
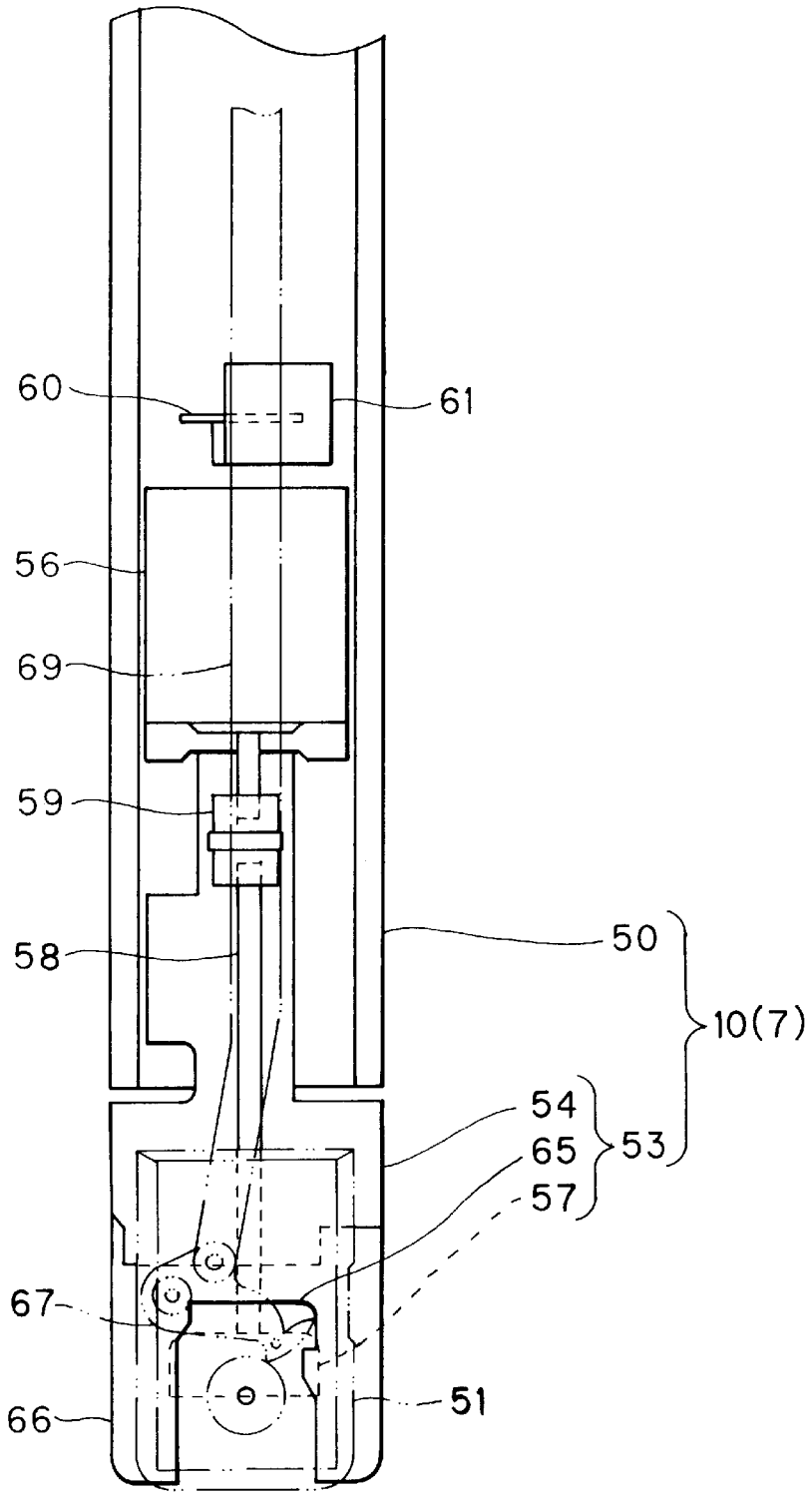
FIG. 6 is a plan view partially in phantom showing the bed unit with the cover plate removed.

Next, a brief explanation for a thread cut mechanism 65 provided in the attachment block 54 will be provided with reference to FIG. 6. A fixing plate 66 fixed to the attachment block 54 extends over the rotary hook 57. A movable blade 67 is rotatably supported by the fixing plate 66. A fixed blade (not shown in the drawings) for cutting the needle thread and the bobbin thread in association with the movable blade 67 is attached under the needle plate 51, which is provided to the right upper side, when viewed in FIG. 6, of the fixing plate 66. Further, a thread cutting operation lever 69 connected to the movable blade 67 extends backward inside the bed case 50. Forward movement of the thread cut operation lever 69 rotates the movable blade 67 in the clockwise direction and brings the needle thread and bobbin thread together. Then, rearward movement of the thread cut operation lever 69 rotates the movable blade 67 in the counterclockwise direction and cuts the needle thread and the bobbin thread at the same time by cooperation of the movable blade 67 and the fixed blade.

To detach the loop taker module 53 from the bed portion 10, first the operator removes the cover plate 52. Then the operator unscrews the screw 55, thereby disconnecting the attachment block 54 from the bed case 50. The user can then remove the attachment block 54, the cutting mechanism, the rotary hook 57, the drive motor 56, and the like from the bed case 50 by lifting the loop taker module 53 upward.

Next, an explanation for the pivot mechanism 70 for switching the position of the bed unit 10 between a horizontal usage position and a retracted position, in which the bed unit 10 is swung downward from the usage position, will be provided while referring to FIGS. 4 to 5 and FIGS. 8 to 9. Again, because three bed units 10 to 12 have the same configuration, the pivot mechanism 70 provided to the leftmost bed unit 10 will be explained as a representative example.

Figure 8:
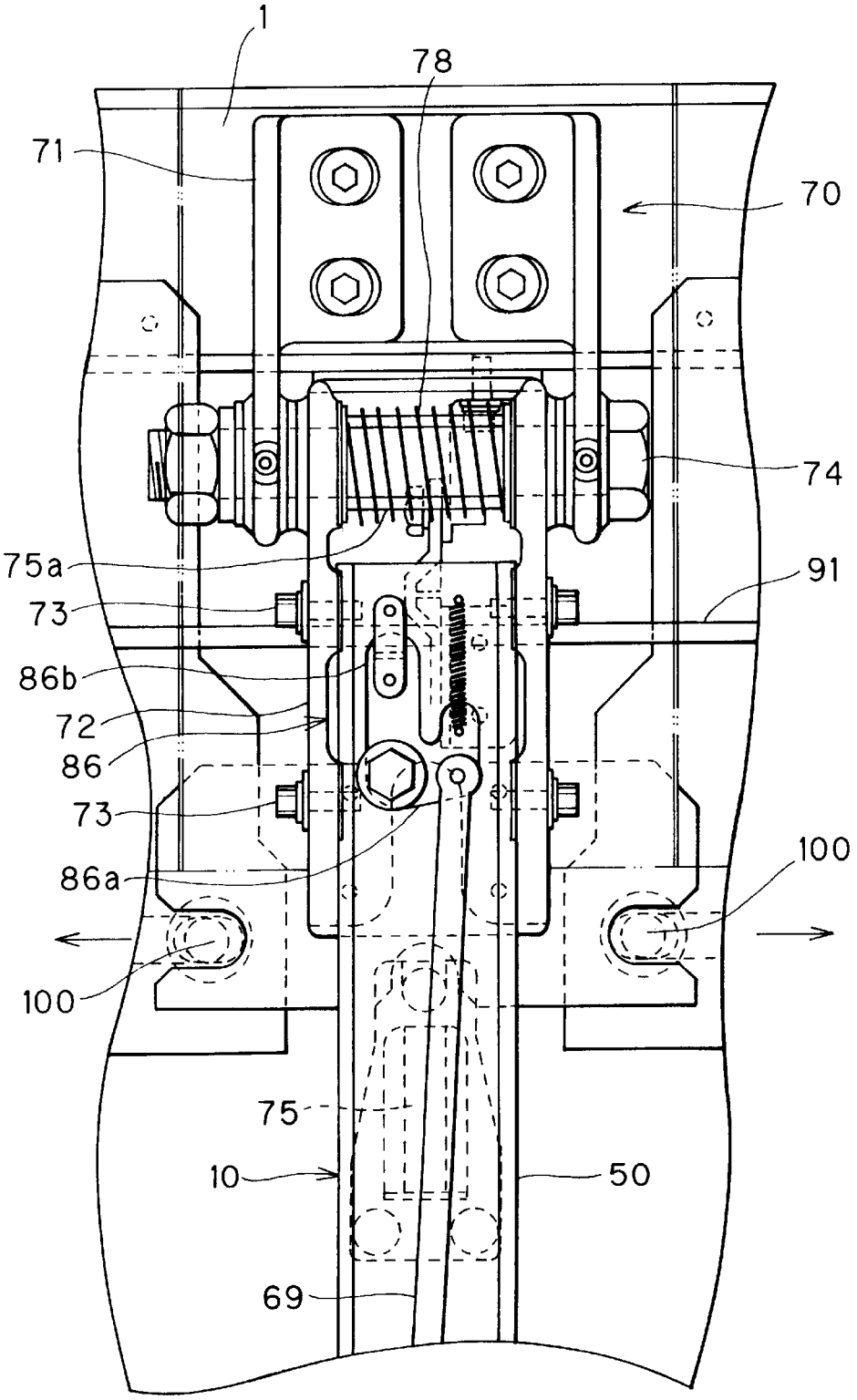
FIG. 8 is a magnified view showing essential portions of a pivot mechanism for switching the bed unit between the usage position and the retracted position.
Figure 9:
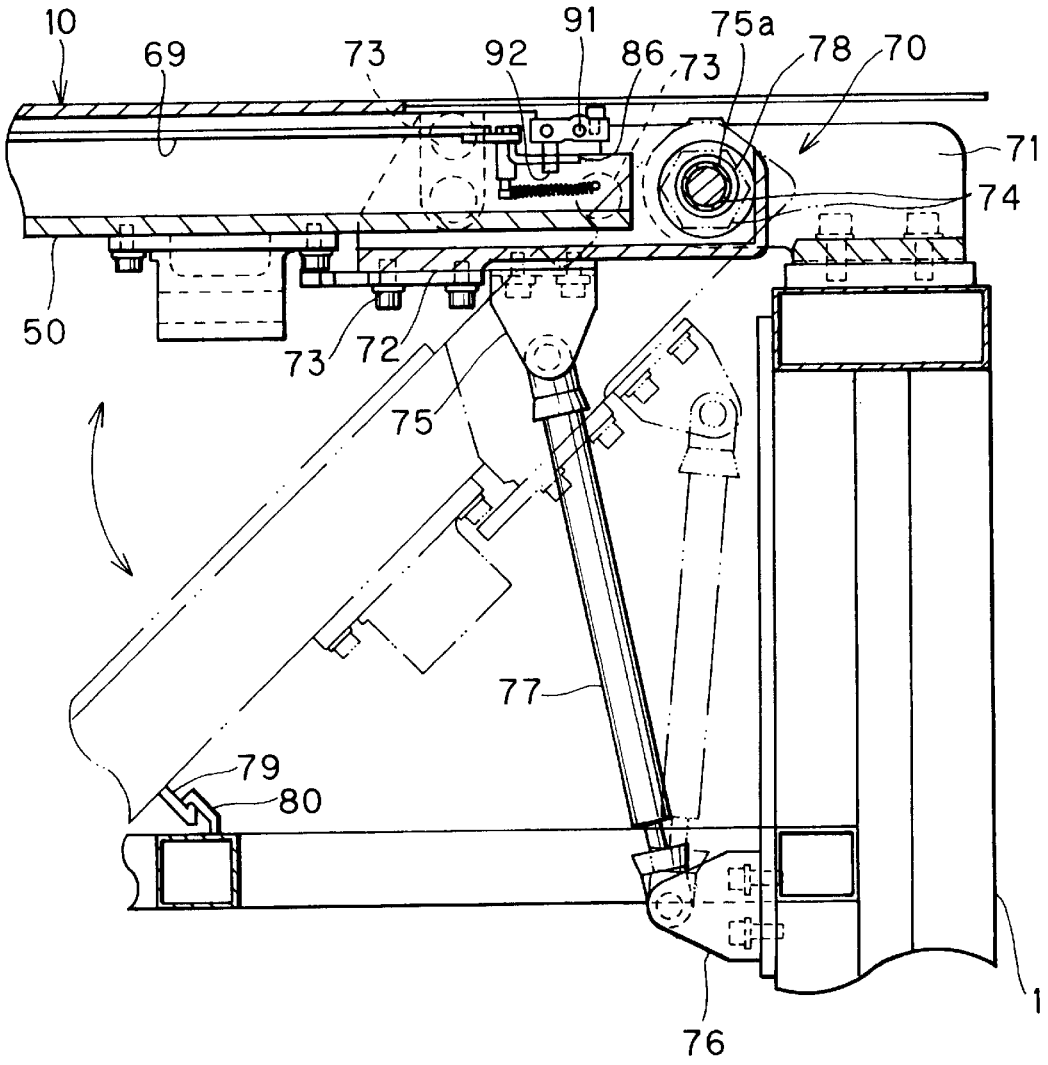
FIG. 9 is a magnified side view partially in cross section showing essential portions of the pivot mechanism.

As best shown in FIGS. 8 and 9, the base of a support bracket 71 is bolted to the base frame 1. On the other hand, the base of the U-shaped bed case 50 at its rear end is fixed by bolts 73 to a connecting bracket 72 also being substantially U-shape in cross section. The rear edge portion of the connecting bracket 72 is supported by the support bracket 71 vertically swingable around a support bolt 74. In other words, the base of the bed unit 10 is supported swingable around a horizontal shaft at right angles to the length direction of the bed portion 7. An air damper 77 is bolted to the lower edge of the connecting bracket 72 and a lower edge of the base frame 1 via a pair of supports brackets 75, 76. A sleeve 75*a* is provided around the support bolt 74 in the support bracket 71. A swing urging spring 78 for urging the bed unit 10 to rotate into the usage position is wound around the sleeve 75*a*.

With this configuration, the bed unit 10 is normally maintained in the horizontal usage position shown by a solid line in FIG. 9 by the strong elasticity of the air damper 77. However, when the bed unit 10 is not in use, the front edge portion of the bed unit 10 is swung downward to the retracted position at substantially 45 degrees as shown by two-dot line in FIGS. 5 and 9. At this point, a hook 79 attached to the bed case 50 engages with an engagement member 80 of the base frame 1 and is fixed in the retracted position. When the hook 79 is released from the holding member 80 by operating a release lever (not shown in the drawings), the bed unit 10 is switched back to it usage position by resilience of the air damper 77. To detach the bed unit 10 from the support frame 3, the operator needs only unscrew the support bolt 74, pull the bolts 100 to the side as indicated by arrows in FIG. 8, and move the bed unit 10 downward.

Figure 4:
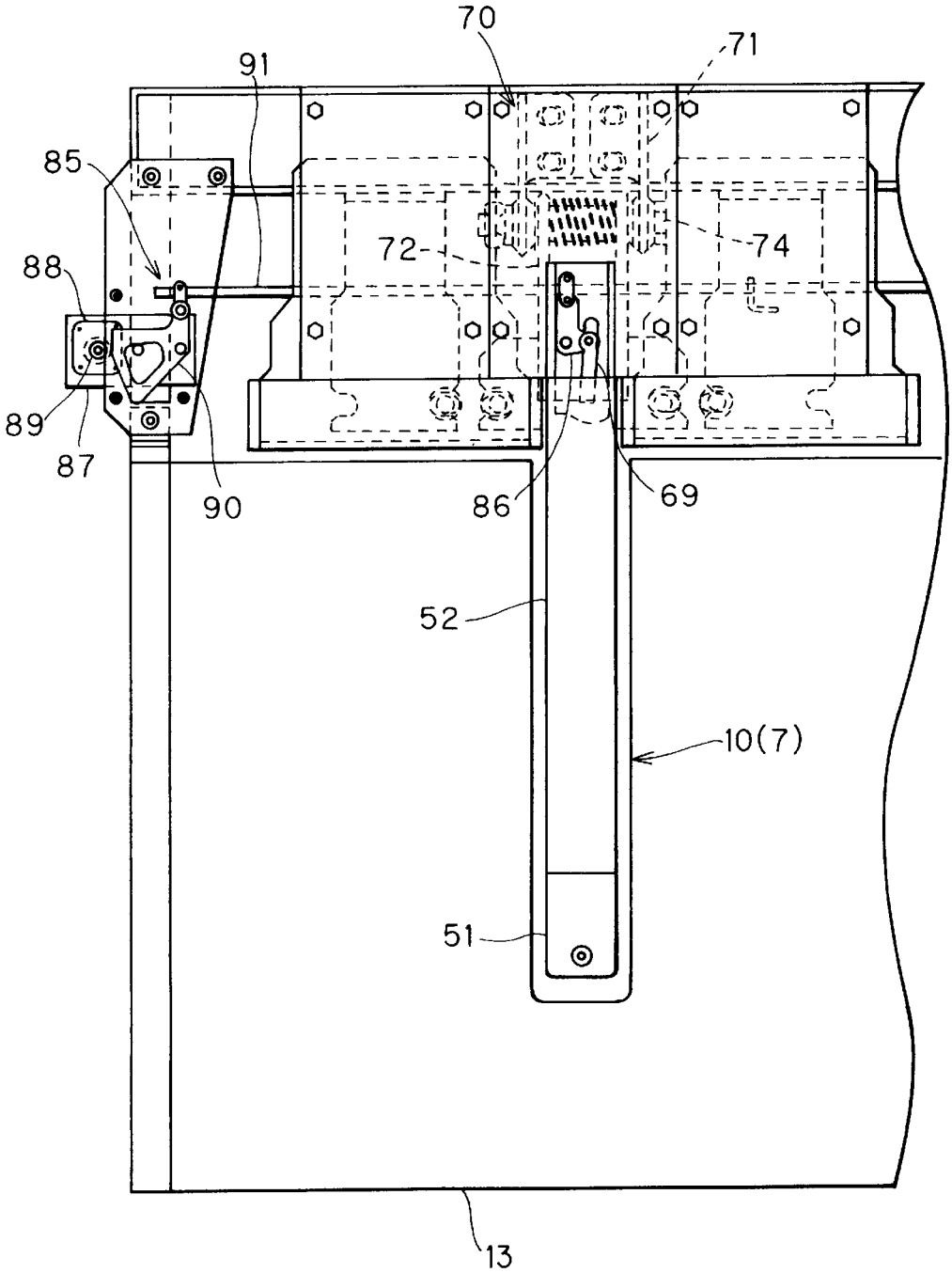
FIG. 4 is a plan view partially in phantom showing a work table and a bed unit detachably provided to the work table.
Figure 5:
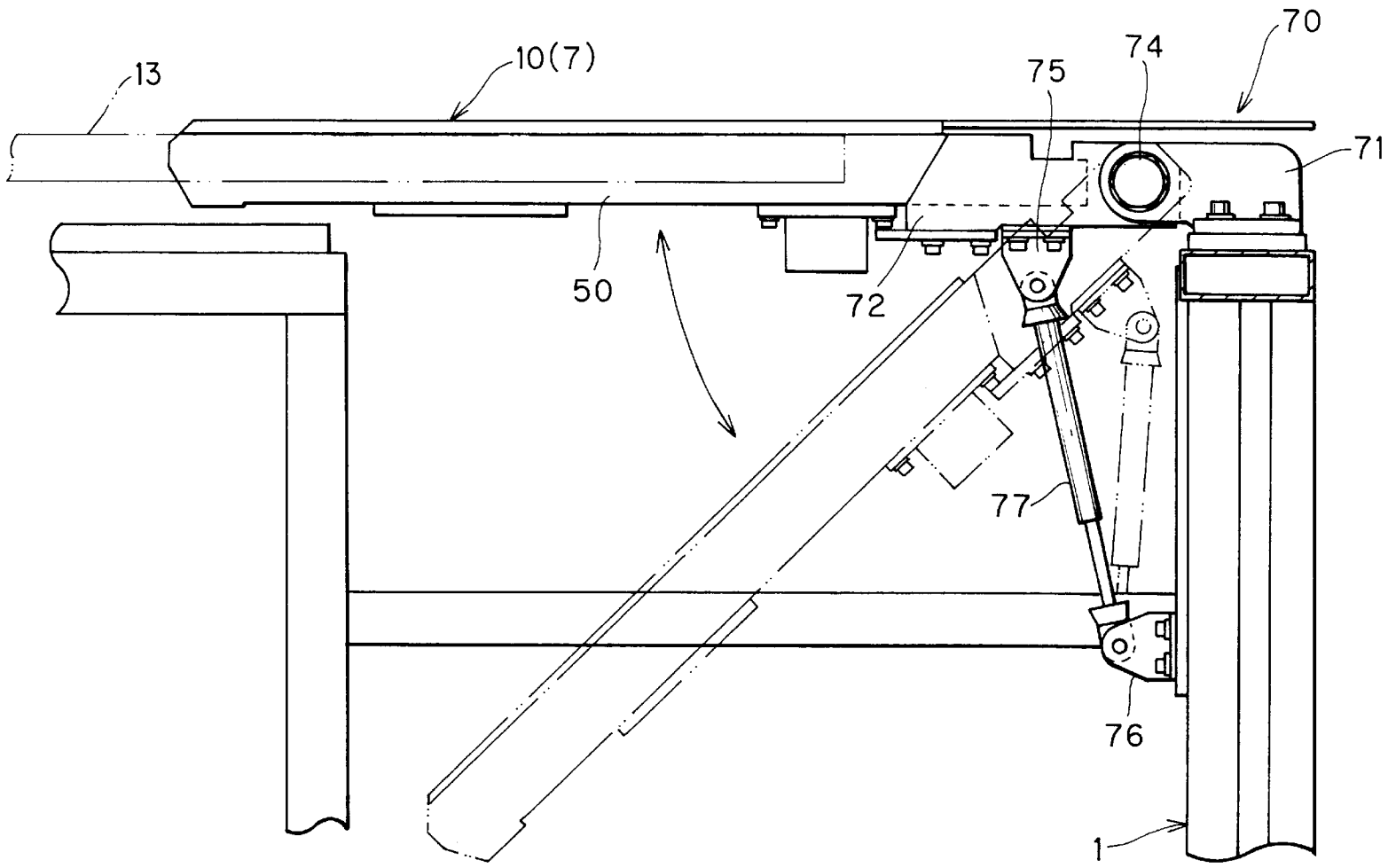
FIG. 5 is a side view showing the bed unit in a usage position (solid line) and a retracted position (two-dot chain line) with respect to the work table.

Next, an explanation for a thread cut drive mechanism 85 for operating the thread cut mechanism 65 provided to the bed unit 10 will be provided while referring FIGS. 4 and 8 to 9.

As shown in FIG. 4, a rotation plate 86 is fixed horizontally rotatable to the rear edge portion of the bed case 50. The rear edge of a thread cut operation lever 6*a* is connected to a slave portion 86*a* (see FIG. 8) of the rotation plate 86. On the left edge portion of the frame 1, a thread cut motor 88 is attached to an attachment plate 87 fixed to the base frame 1. Also, a swing member 90 meshingly engaged with a drive gear 89 of the thread cut motor 88 is rotatably supported by the attachment plate 87. Further, the left edge portion of a horizontally extending thread cut operation shaft 91 is connected to the tip of the swing member 90. A pin member 92 is attached to the thread cut operation shaft 91 at a position corresponding to a drive portion 86*b* of the rotation plate 86. A pin of a pin member 92 is held in a slot formed in the drive portion 86*b* of the rotation plate 86.

With this configuration, the swing member 90 is rotated in the clockwise direction to a predetermined angle by the rotation of the thread cut motor 88 in the counterclockwise direction. The rotation plate 86 is then rotated in the clockwise direction via the rightward movement of the thread cut operation shaft 91, which moves the thread cut operation lever 69 forward. Afterward, the rotation plate 86 is rotated in the counterclockwise direction via the leftward movement of the thread cut operation shaft 91 by the rotation of the thread cut motor 88 in the clockwise direction. As a result, the needle thread and the bobbin thread are cut simultaneously by the thread cut mechanism 65 described above.

Next, an explanation will be provided for effects of the above-described configuration wherein each bed portion 7 to 9 of the multi-head type embroidery machine M is configured from the independent bed units 10 to 12 detachable from the support frame 3 and that enables the bed portions 7 to 9 to switch between the usage position and the retracted position via the pivot mechanism 70.

When each workpiece cloth is small or feeding width in the horizontal direction is broad, all three embroidery machines M1 to M3 can be used by switching the positions of three bed units 10 to 12 to the usage positions. On the other hand, when each workpiece cloth is large or the feeding width in the horizontal direction of cloth to be sewn is narrow, by switching the positions of some of the bed units 10 to 12 to the retracted position and keeping the positions of the other bed units 10 to 12 in the usage position, the embroidery machine M1 to M3 corresponding to the bed units 10 to 12 in the usage position can be used.

Further, the pivot mechanism 70 enables these three bed units 10 to 12 to be switchable between the usage position, wherein the base portions of the bed units 10 to 12 are horizontal with a horizontal support shaft, which is at right angles to the length direction of the bed portions 7 to 9, and the retracted position, wherein the base portions of the bed units 10 to 12 are swung downward by a predetermined angle. As a result, the bed units 10 to 12 can be accurately and easily positioned into the usage position when switched to the usage position. Also, the configuration for enabling the switching process of the position of the bed units 10 to 12 is simple.

Next, effects achieved by providing the loop taker module 53, which includes the rotary hook 57, the loop taker drive motor 56 for driving the rotary hook 57 independently from the sewing machine principal shaft 17, and the thread cut mechanism 65, to the bed units 10 to 12 will be explained.

As described above, when the bed units 10 to 12 are configured so as to be switchable between the usage position and the retracted position, a drive system for transmitting drive force driven by the sewing machine principal shaft 17 to the rotary hook 55 would be extremely complicated. However, because the rotary hook 57 is driven independently from the sewing machine principal shaft 17, it is possible to both drive the rotary hook 57 using a simple drive system and also provide a simple mechanism for switching the position of the bed units 10 to 12. Also, because the loop taker module 53 is detachable, assembly and repair are easier. In particular, the loop taker module 53 can be applied to many different kinds of embroidery machines, which makes the rotary hook 57 and configuration for diving the rotary hook 57 more generally usable.

In this way, the base portions of each bed unit 10 to 12 are configured so as to be switchable between the usage position and the retracted position, which is swung downward from the usage position at a predetermined angle, by providing the pivot mechanism 70 rotatable around the horizontal support shaft, which is at right angles to the length direction of the bed portion 7 to 9. As a result, as required by the size of workpiece cloth or the feeding width of the cloth in the horizontal direction, some of the bed units 10 to 12 can be switched to the retracted position and prevented from interfering with the workpiece cloth. This increases sewing efficiency and versatility of the multi-head type embroidery machine M. Also, the cost of equipment can be reduced by increasing the number of the head portions 4 to 6. Further, positioning the bed units 10 to 12 into the usage position can be accurately and simply performed. The configuration for switching the position of the bed units 10 to 12 can be simplified. Also, operations for switching the position between the usage position to the retracted position can be simplified.

Also, because the rotary hook 57, the loop taker drive motor 56, and the thread cut mechanism 65 are provided together in the loop taker module 53, there is no need to provide a drive force transmission system for transmitting drive force from the principal shaft 17 to the rotary hook 57, so that configuration for driving the rotary hook 57 will be easier. Also, because the loop taker module 53 is detachable, its assembly and repair are easier. By controlling the loop taker drive motor 56, the rotational speed and the rotational position of the rotary hook 57 can be precisely controlled in synchronization with vertical movement of the sewing needle 22 as required by the present sewing conditions.

The loop taker module 53 can be applied to many kinds of embroidery machines so that the rotary hook 57 and the configuration for driving it will be more generally usable. Manufacturing costs of the multi-head type embroidery machine M can be reduced. Also, the shuttle module 52 can be detached when it is not in use so that sewing area or feeding width in the horizontal direction of those embroidery machines M1 to M3 in use can be enlarged and sewing efficiency can be increased.

Next, an explanation will be provided for a guide mechanism 95 for vertically moving a bed unit 10A to the retracted position while maintaining the bed unit 10A in the horizontal posture of the usage position.

Figure 10:
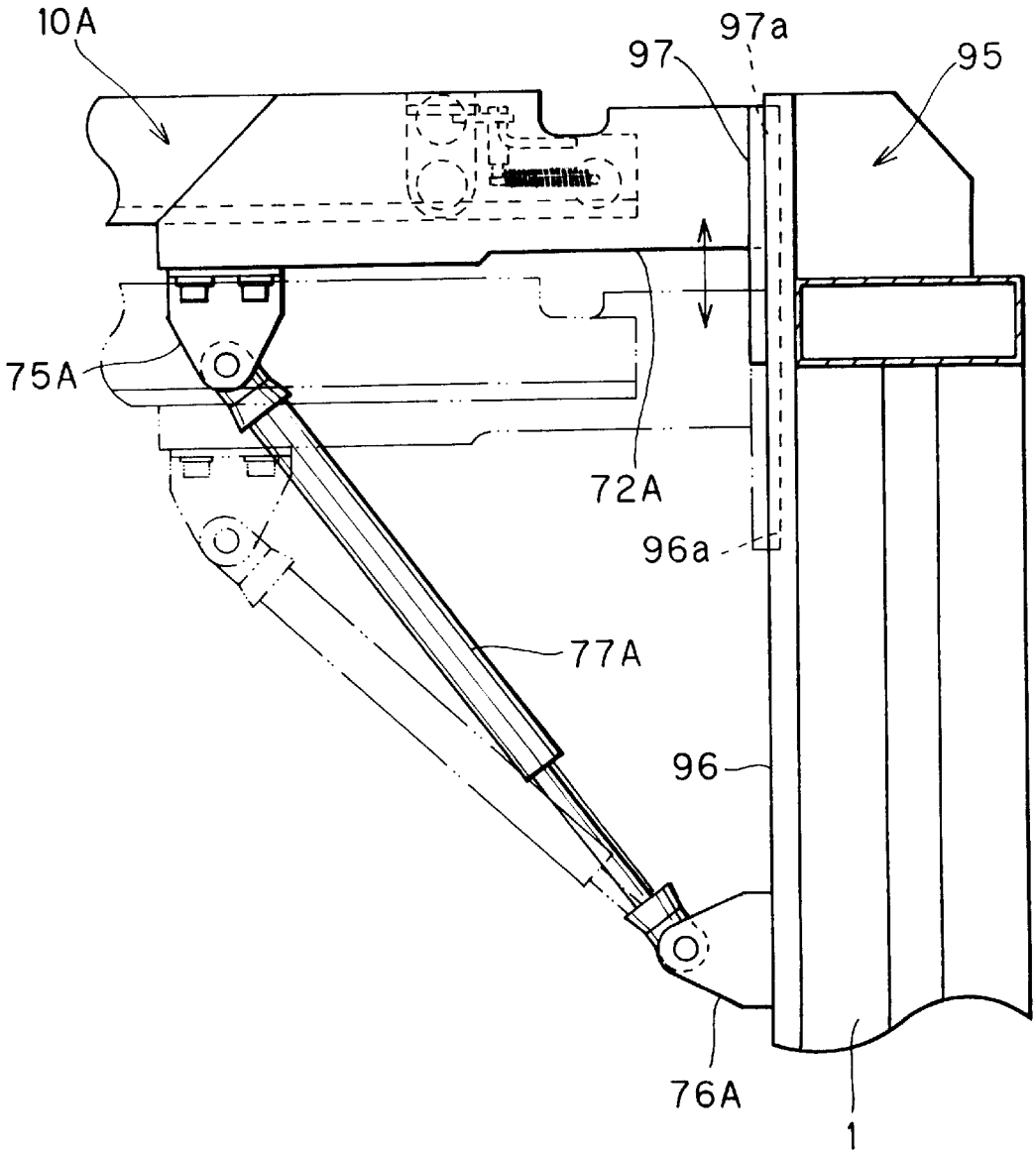
FIG. 10 is a magnified side view showing essential portions of a guide mechanism according to a modification of the embodiment for guiding the bed unit from the usage position into a retracted position while maintaining horizontal posture of the bed unit.

As shown in FIG. 10, an upright guide plate 96 having a predetermined length is attached to the front side of the base frame 1. A wide groove 96*a* is formed T-shaped in cross section in the guide plate 96 to a predetermined length from an upper edge portion to near a central portion of a surface confronting the bed unit 10A. Also, a slide member 97 having an engagement portion 97*a* engageable with the T-shaped groove 96*a* is fixed to the base portion of the bed unit 10A, that is, to the base portion of a connecting bracket 72A. Further, an air damper 77A producing a large resilience force is provided between the connecting bracket 72A and the base frame 1 via a pair of support brackets 75A, 76A.

The bed unit 10A is maintained in the usage position indicated by a solid line in FIG. 10 by the large resilience force of the air damper 77A and can also be switched into the retracted position indicated by the two-dot chain line in FIG. 10 by being pressed downward by a predetermined distance when not in use. Although not shown in the drawings, a lock mechanism is provided to maintain the bed unit 10A in the retracted position. When the lock mechanism is unlocked, the bed unit 10A is returned upward to the original usage position by the resilience force of the air damper 77A.

As described above, the guide mechanism 95 is provided for guiding the bed unit 10A to move upward while maintaining the bed unit 10A in a posture parallel to its posture in the usage position. Also, the bed unit 10A has a configuration capable of switching between the usage position and the retracted position, which is moved downward from the usage position, by a predetermined distance via the guide mechanism 95. As a result, because the bed unit 10A is switchable to the retracted position by moving the whole bed unit 10A downward via the guide mechanism 95, the bed unit 10A can be prevented from interfering with the workpiece cloth when not in use.

It should be noted that the bed unit 10 to 12 can be configured detachable at their base portions to the frame 1. In this case, in the same manner as described in the previous embodiments, some of the bed units 10 to 12 can be detached according to the size or the feeding width of the workpiece cloth, or as necessity dictates, so that the bed units 10 to 12 can be prevented from interfering with the workpiece cloth. As a result, sewing efficiency and general usability of the multi-head type embroidery machine M can be increased. Equipment costs can be reduced by increasing the number of the head portions 4 to 6 per system. Also, because the entire bed unit is retracted away from the needle case, there is less chance of the retracted bed unit from interfering with sewing operations.

While the invention has been described in detail with reference to specific embodiments thereof, it would be apparent to those skilled in the art that various changes and modifications may be made therein without departing from the spirit of the invention, the scope of which is defined by the attached claims.

For example, the pivot mechanism 70 can be configured from many different kinds of components and still be capable of switching the bed unit 10 to 12 between the usage position and the retracted position. Also, the guide mechanism 95 can be configured from different components than those described above and still be capable of vertically moving the bed unit 10 to 12 between the usage position and the retracted position. The loop taker module 53 can be formed in a block shape including the loop taker drive motor 56 or the rotary hook 57. Also, the rotary hook 57 can be replaced with any type of loop taker, such as a oscillating shuttle, or a looper. Further, the present invention can be applied to a single-head type embroidery machine. In this case, the bed units can be switched to the retracted position to facilitate repair of a rotary hook provided inside of the bed portion, its drive system, or other relative parts.

What is claimed is:

1. A sewing device comprising:

a plurality of head portions each for mounting a needle;

a support frame; and a plurality of bed units supported on the frame, each having a loop taker for catching thread loops, each bed unit being selectively switchable between a usage position in confrontation with its corresponding head portion and a retracted inoperative position retracted away from its corresponding head portion compared with the usage position.

2. A sewing device as claimed in claim 1, wherein each of the bed units has a length extending in a lengthwise direction when the bed units are in the usage position and further comprising:

a respective pivot mechanism for each bed unit having a horizontal shaft extending perpendicular to the lengthwise direction and pivotably supporting each of the bed units, the bed units being switchable to the retracted inoperative position from the usage position by swinging downward around the shaft to a predetermined angle from the usage position.

3. A sewing device as claimed in claim 2, wherein each of the bed units is independent and detachable from the support frame.

4. A sewing device as claimed in claim 3, further comprising:

a principal shaft extending horizontally through the plurality of head portions for transmitting drive force to drive each of the head portions; and a respective drive motor for driving each of the loop takers independently from the principal shaft.

5. A sewing device as claimed in claim 4, wherein each of the loop takers and its respective drive motor are provided as an independent module detachable from the bed unit.

6. A sewing device as claimed in claim 5, further comprising a thread cutting mechanism provided in each of the independent modules with the loop taker.

7. A sewing device as claimed in claim 6, wherein each of the thread cutting mechanisms includes:

a movable blade; and a thread cutting operation lever connected to the movable blade and extending through the bed unit.

8. A sewing device as claimed in claim 1, wherein each of the bed units has a horizontal posture when in the usage position and each of the bed units further comprising:

a guide mechanism for guiding the bed unit from the usage position a vertical distance to the retracted inoperative position while maintaining the horizontal posture of the bed unit.

9. A sewing device as claimed in claim 8, wherein each of the bed units is independent and detachable from the support frame.

10. A sewing device as claimed in claim 9, further comprising:

a principal shaft extending horizontally through the plurality of head portions for transmitting drive force to drive each of the head portions; and a respective drive motor for driving each of the loop takers independently from the principal shaft.

11. A sewing device as claimed in claim 10, wherein each of the loop takers and its respective drive motor are provided as an independent module detachable from the bed unit.

12. A sewing device as claimed in claim 8, wherein each of the guide mechanisms includes:

a groove portion of the support frame, the groove portion being formed with a vertically running groove; and a slide member of the bed unit, the slide member having an engagement portion engageable with the groove of the groove portion.

13. A sewing device as claimed in claim 1, further including a bed portion associated with each of said bed units, said bed portions each having an upper surface and further comprising an operation table having an upper surface, each of the bed portions being supported so that its upper surface is flush with the upper surface of the operation table in its usage position and out of flush with the upper surface of the operation table in its retracted inoperative position.

14. A sewing device as claimed in claim 1, wherein the plurality of bed units are configured such that every other bed unit can be switched to its retracted inoperative position.

15. A sewing device as claimed in claim 14, wherein said every other bed unit of the plurality of bed units is detachable from said support frame.

16. A sewing device as claimed in claim 15, said every other bed unit being attached to said support frame wherein at least one of said support frame and said every other bed unit having slots, the other of said support frame and said every other bed unit having mating elements, wherein said mating elements are matingly insertable into said slots.

17. A sewing device as claimed in claim 1, further including a movable frame, said movable frame movable in X and Y directions.

18. A sewing device comprising:

a head portion for mounting a needle;

a support frame;

a bed portion independently and detachably supported by the frame, said bed portion being attached to said support frame, at least one of said support frame and said bed portion having slots, the other of said support frame and said bed portion having mating elements, wherein said mating elements are matingly insertable into said slots;

a principal shaft for transmitting drive force to drive the head portion;

a loop taker for taking a thread loop; and a drive motor for driving the loop taker independently from the principal shaft.

19. A sewing device as claimed in claim 18, wherein the loop taker and the drive motor are provided as an independent module detachable from the bed portion.

20. A sewing device as claimed in claim 18, wherein said bed portion is pivotably attached to said frame.

21. A sewing device as claimed in claim 18, having a plurality of head portions and a plurality of bed portions corresponding with said head portions.

22. A sewing device as claimed in claim 21, further including a movable frame, said movable frame movable in X and Y directions.

* * * * *